US005839980A

United States Patent [19]

Kendy

[11] Patent Number: 5,839,980

[45] Date of Patent: Nov. 24, 1998

[54] SOCCER GOAL ASSEMBLY AND APPARATUS

[76] Inventor: Hossein Kendy, 2737 Brassie Dr., Glenview, Ill. 60025

[21] Appl. No.: 870,912

[22] Filed: Jun. 6, 1997

[51] Int. Cl.[6] ..... A63B 63/00

[52] U.S. Cl. ..... 473/478; 273/400

[58] Field of Search ..... 473/478, 212; 273/400

[56] References Cited

U.S. PATENT DOCUMENTS 5,273,292 12/1993 Pardi et al. ..... 273/400

5,586,768 12/1996 Pavonetti ..... 473/478

*Primary Examiner*—William H. Grieb

*Attorney, Agent, or Firm*—Fitch, Even, Tabin & Flannery

[57] ABSTRACT

A soccer goal assembly and apparatus includes a goal frame (20), a pivotable net frame (28), a pair of support bars (31), and a net (50). The goal frame (20) is located at the front of the goal and includes a pair of vertical posts (22) and a horizontal cross bar (23) connecting the upper ends of the vertical posts (22). A ground-level housing (26) is connected rearwardly and orthogonally to the lower ends of the vertical posts (22). The housing (26) includes a lockable compartment for storing the net (50). The net (50) is attached to the housing (26) and net frame (28). The support bars (31) are attached to the housing (26) and goal frame (20) in a manner to support the net (50) while in use during game play. When the net frame (28) pivots from a horizontal position to a vertical position abutting the goal frame (20), it pulls the net (50) over the support bars (31) to form a soccer goal enclosure. The arms (76) of the net frame are extensible to allow for the difference in the height and depth of the goal. The soccer goal assembly can be adapted to retrofit onto existing goal frames. This allows a user to save the cost of replacing an already emplaced goal frame.

20 Claims, 16 Drawing Sheets

SOCCER GOAL ASSEMBLY AND APPARATUS

TECHNICAL FIELD

The present invention relates generally to athletic equipment and, in particular, to an improved soccer goal.

BACKGROUND OF THE INVENTION

Soccer is currently the most popular team sport in the world. A soccer playing field has two goals at opposite ends. The objective of the game is to score points by kicking a ball into an opposing team's goal.

A conventional soccer goal consists of a rigid frame and a net. The frame defines the physical dimensions of the goal and supports the net. The primary purpose of the net is to stop the ball after it is kicked into the goal.

Soccer goals come in a variety of sizes. Two organizations that regulate the physical dimensions of soccer goals are the Federation of International Football Association (FIFA) and the National Collegiate Athletic Association (NCAA). The FIFA regulations, which are commonly used by professional soccer leagues, require a goal to have a frontal opening for receiving a kicked ball that is twenty-four feet in width and eight feet in height. The NCAA standard is provided by rule 1—10 of the 1996 NCAA Soccer Mens and Womens Rule Book. This standard requires a soccer goal to have the same FIFA dimensions and additionally requires the depth of the goal behind the opening to be at least two feet at the cross bar level.

Soccer goals are also available in non-standard sizes having frontal openings that range from 20'×7' to 6'×4'. However, to attain commercial success, a soccer goal should conform to FIFA or NCAA standards.

A common problem associated with maintaining a soccer field is that soccer nets are exposed to weather and vandalism, which eventually renders them unsuitable for use. To prevent premature deterioration of the soccer net, a user typically removes the net from the frame after each use and then re-installs it prior to each use. The task of removing and replacing a soccer net is time consuming and thus costly. Thus, there is a need for an improved soccer goal that significantly reduces the burden of installing the soccer net.

The prior art has attempted, in part, to address the problem described above. U.S. Pat. Nos. 5,518,252; 5,413,356; and 5,186,469 illustrate several such attempts.

U.S. Pat. No. 5,518,252 discloses a storage enclosure for a net that mounts on the upper cross bar of a soccer goal. A pair of rotatably mounted poles support the net, and when not in use, fold into the storage enclosure. The enclosure is mounted high off the ground. This requires a user to elevate himself or use some other means to reach the enclosure in order to operate the poles. Furthermore, the disclosed assembly fails to conform to NCAA standards for goal dimensions. As a result, the '252 soccer goal is generally inconvenient to use and undesirable for NCAA regulated soccer games.

U.S. Pat. No. 5,413,356 discloses a two frame soccer goal that includes a compartment for storing the net. One of the frames is raised into a vertical position to unfold the net into a playing position. The '356 patent fails to disclose a goal that conforms NCAA standards for goal dimensions. Particularly, '356 soccer goal does not conform with the goal depth requirement of the NCAA regulation. As a result, the '356 soccer goal is also undesirable for NCAA regulated games.

U.S. Pat. No. 5,186,469 discloses a foldable soccer goal having a frame that pivots from a horizontal to vertical position to form goal posts and an upper cross bar. When the frame pivots into the vertical position, it pulls a net into a playing position. Because the pivotable frame includes the goal post and cross bar, it is cumbersome to use. Furthermore, the '469 soccer goal does not conform with the goal depth requirement of the NCAA regulation. As a result, the goal is difficult to use and undesirable for NCAA regulated soccer games.

It is apparent that there is a significant need for an improved soccer goal that overcomes the problems and disadvantages of the prior art goals described above.

SUMMARY OF THE INVENTION

An advantage of the present invention is that it provides a soccer goal that securely stores the net when not in use. Another advantage of the present invention is that it provides a soccer goal that conforms to FIFA and NCAA regulations regarding goal dimensions. A further advantage of the present invention is that it provides a soccer goal that is easy, safe, and convenient to operate. The present invention substantially reduces the setup and take-down time for a soccer net. It is also an advantage of the present invention to provide a soccer goal assembly kit that can be fitted to existing goal frames at established soccer fields.

According to one aspect of the present invention, a soccer goal includes a ground-level housing connected to the lower ends of a goal frame and extending substantially orthogonally therefrom. The soccer goal also includes a net frame that pivots between the goal frame and the housing. The net frame has a pair of extensible arms coupled to pivots attached to either the housing or goal frame. As the net frame is pivoted between the goal frame and the housing, the length of each extensible arm changes. This allows the soccer goal to conform to NCAA standards for goal depth.

According to another aspect of the present invention, a soccer goal assembly kit includes a housing having an open top side. The housing is adapted to attach to a goal frame. Also included are a pair of pivots and a pair of rigid support bars, both of which are adapted to attach to the housing. A net frame having a pair of extensible arms is adapted to connect to the pivots and to slide over the support bars. The net frame is also adapted to couple to the top side of the housing to form a compartment for storing a net.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings, in which:

DETAIL DESCRIPTION OF A EMBODIMENT

Figure 1:
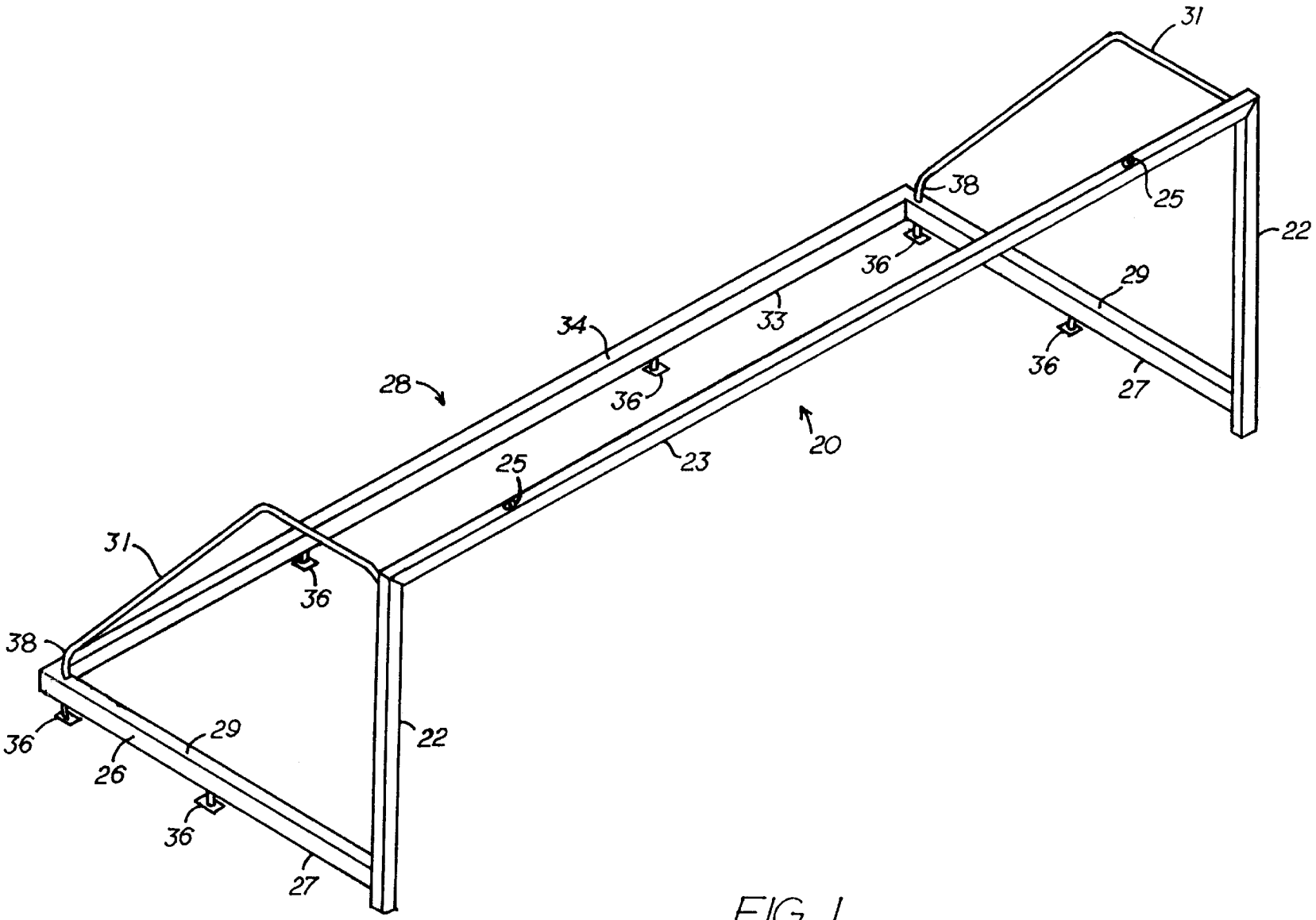
FIG. 1 is a perspective view of a soccer goal according to one embodiment of the present invention.

FIG. 1 illustrates a soccer goal conforming with a first embodiment of the present invention. The soccer goal includes a goal frame 20, a housing 26, a net frame 28, a pair of rigid support bars 31, and a plurality of anchors 36. The goal frame 20 comprises two vertical posts 22 and a cross bar 23. Two pulleys 25 for guiding a rope are mounted on top the cross bar 23. Connected to the lower ends of the vertical posts 22 are the housing legs 27. The legs 27 extend orthogonally and rearwardly from the vertical posts 22 and connect to the back member 33 of the housing 26. The housing 26 is hollow and has an open top side. Attached to the bottom of the housing are the anchors 36, which secure the housing 26 to the playing field.

The support bars 31 attach to the goal frame 20 and the housing 26. Any means can be used to fasten the support bars 31 to the housing 26 and goal frame 20. However, the support bars 31 preferably include flanges at their ends to allow them to be bolted to the housing 26 and goal frame 20.

The net frame 28 includes a horizontal member 34 and a pair of extensible arms 29 attached to either end of the horizontal member 34. The net frame 28 can pivot between the goal frame 20 and the housing 26. In FIG. 1, the net frame 28 is shown in its horizontal or closed position. In this position, the net frame 28 engages the open top side of the housing 26 to form an enclosed compartment for storing a soccer net.

The extensible arms 29 of the net frame 28 connect to pivots (not shown) attached to either the housing 26 or the vertical posts 22. Preferably, the pivots are located on the vertical posts 22. At its upper end, the net frame 28 has holes through which the support bars 31 pass. This allows the net frame 28 to slidably engage the support bars 31. As the net frame 28 slides along the support bars 31, the extensible arms 29 change length to accommodate the movement of the net frame 28.

A net (not shown) is attached to the housing 26 and the net frame 28. The support bars 31 support the net in the proper position during game play.

Figure 2:
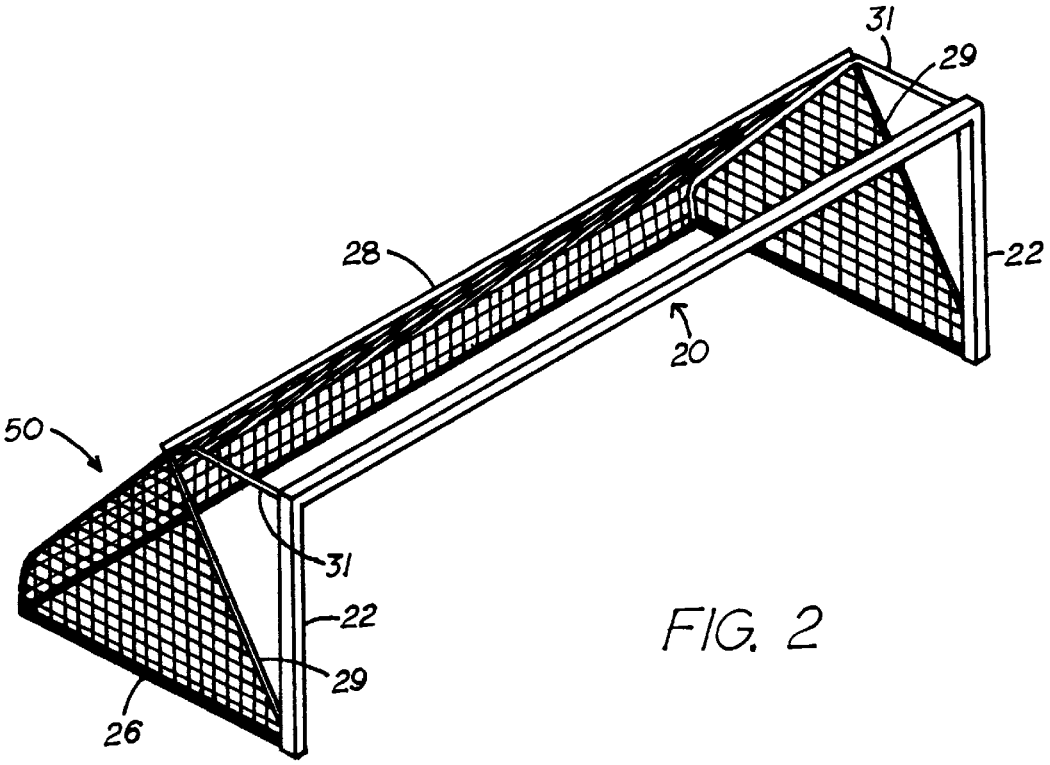
FIG. 2 is a perspective view of the soccer goal shown in FIG. 1 with the net frame in an open position.

FIG. 2 shows the net frame 28 in an open position. The net 50 is partially unfurled from the storage compartment of the housing 26.

Figure 3:
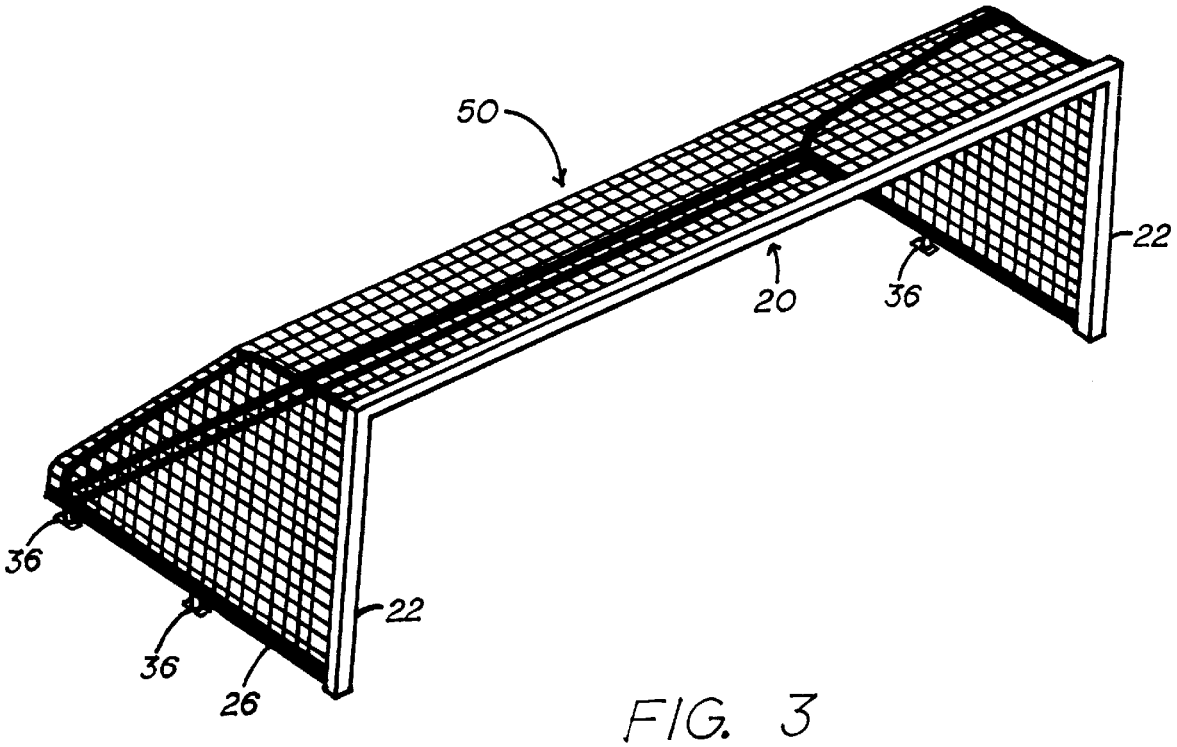
FIG. 3 is a perspective view of the soccer goal of FIG. 1 with the net frame in a playing position.

FIG. 3 shows the net frame 28 in a vertical playing position. In this position, the net frame 28 is locked to the goal frame 20 and the net 50 is fully unfurled over the support bars 31 to form the goal enclosure.

Figure 4:
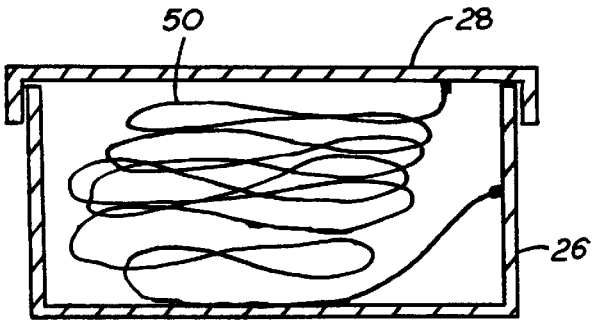
FIG. 4 is a cross-sectional view of the net storage compartment of the soccer goal shown in FIG. 1.

FIG. 4 is a cross-sectional view of the net storage compartment of the soccer goal shown in FIG. 1. The compartment is formed when the net frame 28 is in a horizontal position. The net 50 is safely stored in the space between the net frame 28 and the hollow housing 26. Any means, such as electrical wire ties, hog rings, bolts, screws, or adhesives, can be used to attach the net 50 to the housing 26 and the net frame 28. To prevent unauthorized use, the net frame 28, in its horizontal position, can be locked to the housing 26.

Figure 5:
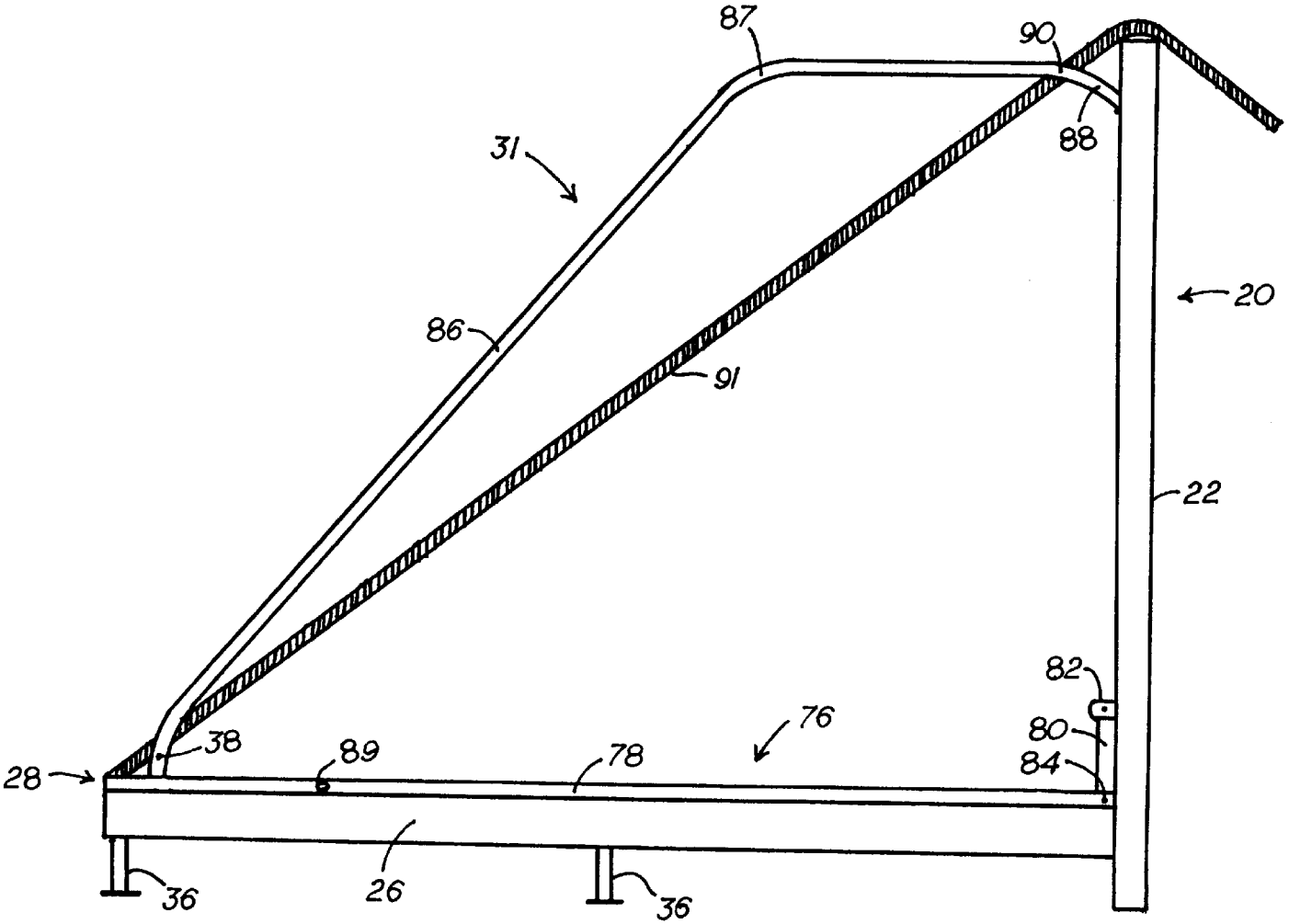
FIG. 5 is a side view of the soccer goal shown in FIG. 1 with the net frame in a horizontal position.

FIG. 5 is a side view of the soccer goal shown in FIG. 1. In FIG. 5, the net frame 28 is in its horizontal position. Included in this view are a spring-loaded push button 38, a lock 89, a rope 91, and a preferably embodiment of an extensible arm 76.

The preferred extensible arm 76 includes a primary bar 78 attached to one end of the net frame horizontal member 34. A secondary bar 80 is coupled a pivot 82, which is attached to the vertical post 22. An off-axis pivot 84 couples the primary and secondary bars 78,80 to one another. This arrangement allows an extra degree of freedom in the movement of the net frame 28 as it passes between vertical and horizontal positions. The radial length of the extensible arm 76 is defined as the distance from the pivot 82 to the end of the primary bar 78 that is attached to the horizontal member 34. The double-pivot arrangement of the extensible arm 76 allows the radial length to vary. This feature of the soccer goal allows the net frame 28 to easily slide along non-circular support bars, such as those shown in FIGS. 1–6.

The rope 91 is used to pull the net frame 28 into the vertical position. The rope 91 can be made of any suitable material, such as nylon, cotton, wire, cable, or hemp. As shown, the rope is simply placed over the cross bar 23 of the goal frame 20 and a user standing in front of the goal pulls the rope 91 to lift the net frame 28. Preferably, the rope 91 attaches to both ends of the horizontal member 34 in a continuous loop that drapes over the cross bar 23. However, other mechanisms can be used to pull the rope 91. For instance, one or more manual or electric winches attached to the goal frame 20 could be used to pull the rope 91. Or, pulleys could be placed on top of the cross bar 23 to reduce the friction caused by the rope 91 rubbing against the cross bar 23.

The support bars 31 define the height of the goal behind the goal frame 20. Each support bar 31 includes a first segment 86 attached to the housing 26 and extending to a bending point 90 at a first height approximately even with the cross bar 23. To conform with NCAA regulations for goal dimensions, the first segment 86 is preferably bent at a knee 87 to provide proper upper depth. However, in other embodiments of the soccer goal, the first segment can be straight or semi-circular.

A second segment 88 extends from the bending point 90 to a location on the goal frame at a second height less than the first height. The second segment 88 is pitched so that the net frame 28 in the vertical position will rest safely against the goal frame 20, without the risk of falling back into the horizontal position, until the user is able to lock the net frame 28 to the goal frame 20. Considering that a regulation net frame, at 8'×24', represents a relatively dangerous falling object, it is apparent that this particular feature of the soccer goal provides a substantial improvement over prior art soccer goals.

The anchors 36 include flanges for bolting the soccer goal to a playing surface. This embodiment of the anchors 36 is useful for indoor soccer arenas.

The lock 89 is used to lock the net frame 28 to either the housing 26 when the goal in not being used, or to the goal frame 20 when in use.

Figure 6:
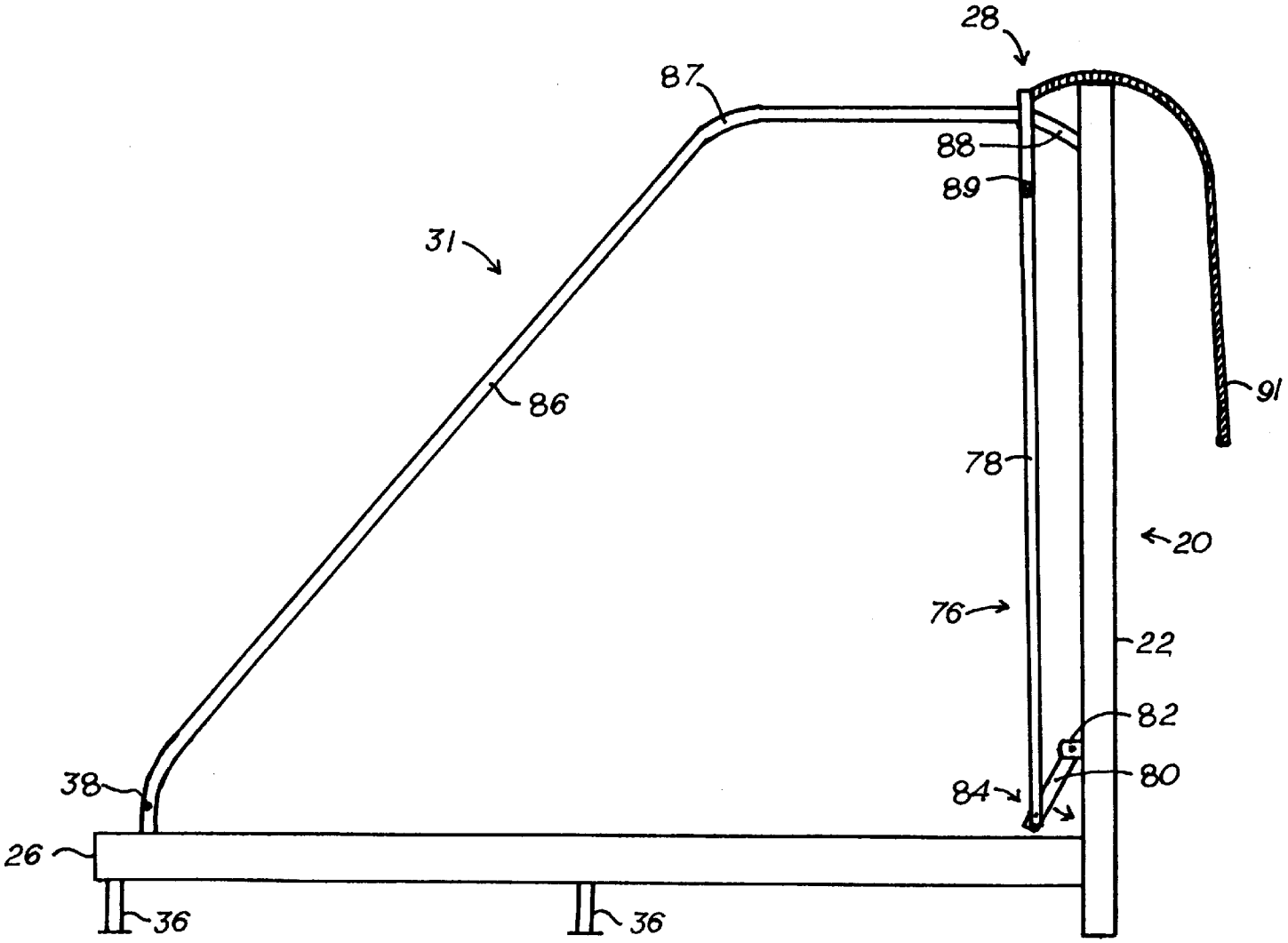
FIG. 6 is a side view of the soccer goal shown in FIG. 1 with the net frame in a vertical position.

FIG. 6 is a side view of the soccer goal shown in FIG. 1 with the net frame 28 in a vertical position. The net 50 is normally in view when the net frame 28 is vertical. However, for clarity, the net 50 has been omitted from FIG. 6.

As the net frame 28 moves into the playing position against the goal frame 20, the off-axis pivot 84 rotates about the pivot 82 toward the lower end of the vertical post 22. In the playing position, the net frame 28 is flush against the goal frame 20 and locked into place with the lock 89. The primary bar 78 is preferably a three-sided rectangular beam having inner dimensions that are slightly larger than the outer dimensions of the secondary bar 80 and the pivot 82. The open side of the beam faces the goal frame 20. Thus, when in a playing position, the primary bar 78 covers the secondary bar 80 and the pivot 82.

The net 50 (not shown) is preferably attached to the primary bar 78 and not the secondary bar 80.

Figure 7:
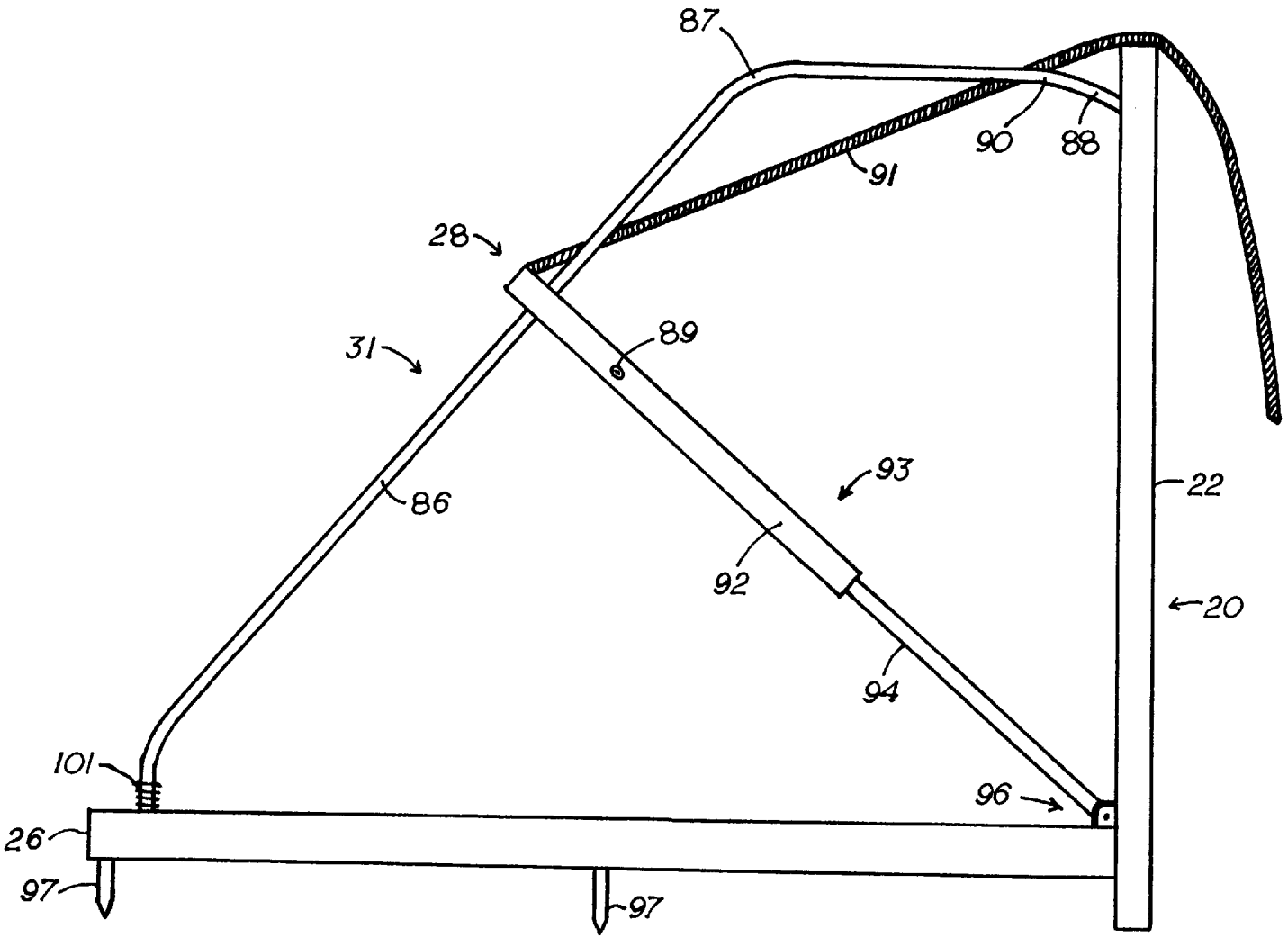
FIG. 7 is a side view of the soccer goal of FIG. 1 according to a second embodiment of the present invention.

FIG. 7 is a side view of the soccer goal of FIG. 1 according to a second embodiment of the present invention. This embodiment includes an extensible arm 93 comprising a first bar 92 and a second bar 94 that is slidable within the first bar 92. The second bar 94 is coupled to a pivot 96 that is attached near the joint of the vertical post 22 and the housing 26. The pivot 96 can be attached to either the housing 26 or the vertical post 22.

One or more springs 101 are used to bias the net frame 28 into an open position slightly above the housing 26. This is to prevent the net frame 28 from slamming into the housing 26 if it is inadvertently dropped into the horizontal position. As shown in this example, the spring 101 is concentrically positioned about the support bar 31 and rests on the housing 26.

Also included in this embodiment are pointed anchors 97 that can be driven into the playing surface. The pointed anchors 97 are useful for securing the goal to outdoor playing fields.

Figure 8:
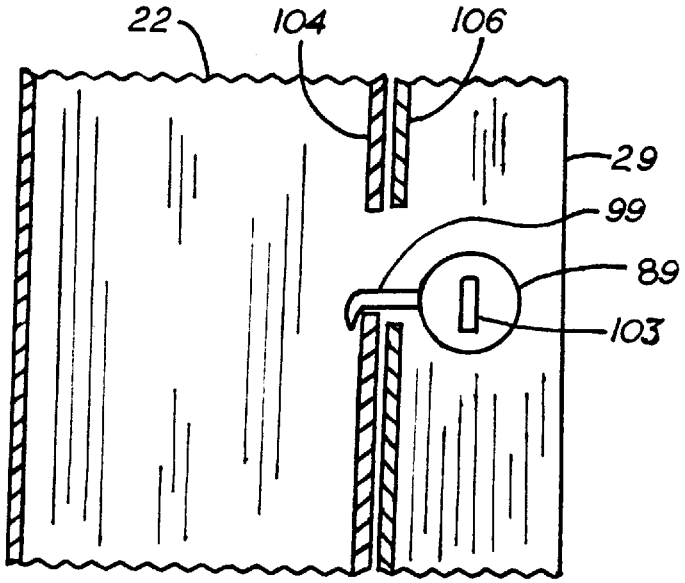
FIG. 8 is a detailed view of the lock shown in FIGS. 5–7.

FIG. 8 is a detailed view of the lock 89 shown in FIGS. 5–7. In this exemplary side view, one of the extensible arms 29 is locked to the back wall 104 of one of the vertical posts 22. By inserting a key (not shown) into the keyhole 103, the latch 99 can be rotated through a hole in the forward wall 106 of the extensible arm 29 to hook onto the back wall 104 of the vertical post 22.

Figure 9:
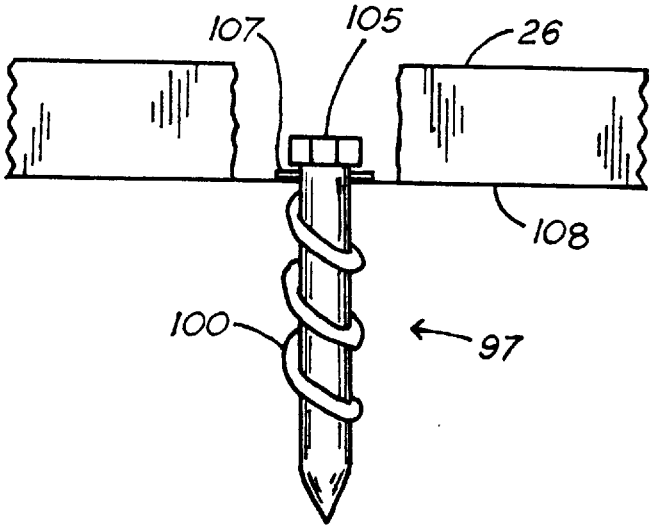
FIG. 9 is a detailed view of one of the anchors shown in FIG. 7.

FIG. 9 is a detailed cut-away view of one of the pointed anchors 97 attached to the housing 26. The pointed anchor 97 includes an auger 100 and a hexagonal head 105. The anchor 97 passes through a hole in the bottom 108 of the housing 26. A washer 107 is used to retain the anchor 97 in place. The goal is fastened to a playing field by screwing the anchor 97 into the ground using a wrench or any other suitable tool designed to fit the hexagonal head 105.

Figure 10:
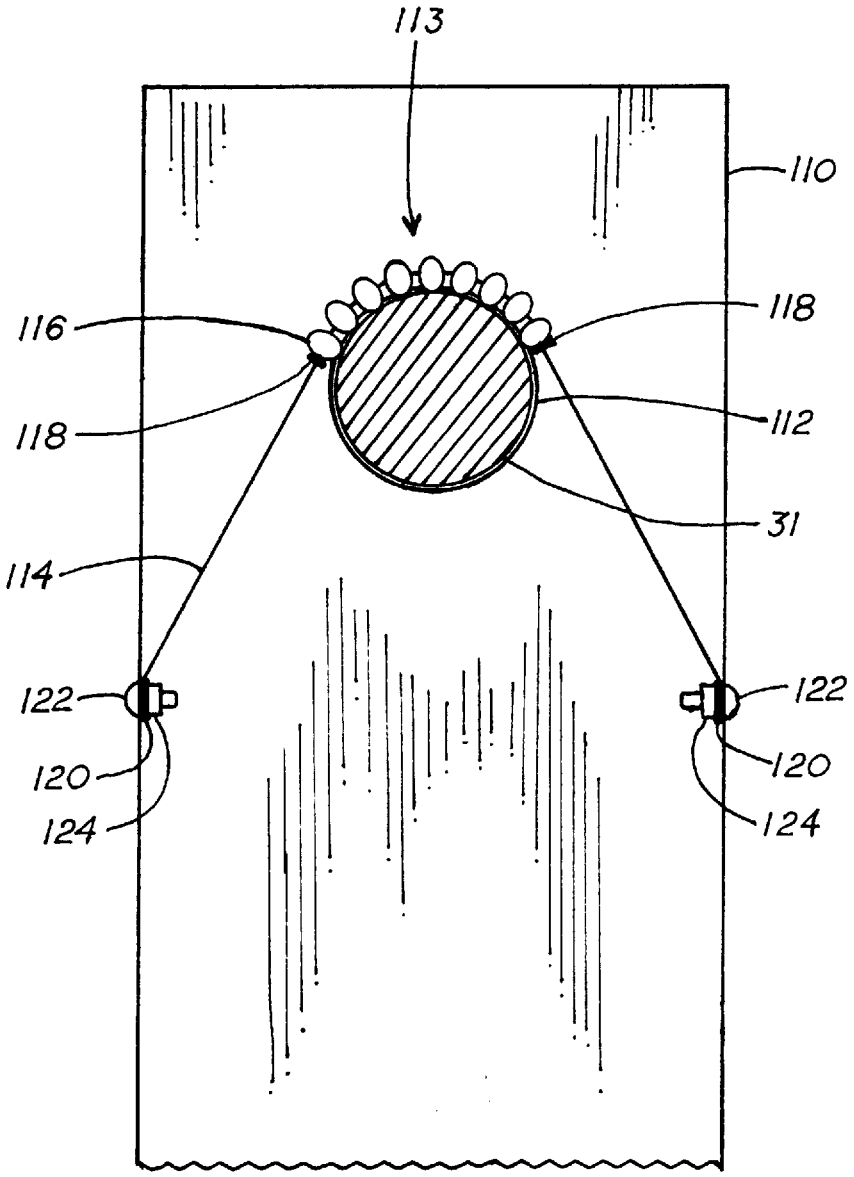
FIG. 10 is a detailed view of a first embodiment of a net frame roller mechanism includable in the soccer goal of FIG. 1.

FIG. 10 is a detailed view of a net frame roller mechanism 113 includable in the soccer goal of FIG. 1. The roller mechanism 113 reduces the friction created by moving the net frame 28 over the support bars 31. A cross-sectional view of one of the support bars 31 is shown passing through a hole 112 in the upper portion 110 of one of the extensible arms 29.

The roller mechanism 113 includes a wire 114 having eyelets 120 at either end. A plurality of rollers 116 are disposed along the wire 114. Retainers 118 are included to keep the rollers 116 in place. The wire 114 passes through the axis of each of the rollers 116 in a manner that allows the rollers 116 to freely rotate about the wire 114. The rollers 114 contact the support bar 31 and rotate as the net frame 28 is moved. The eyelets 120 are fasted to the upper portion 110 of the extensible arm 29 using screws 122 and nuts 124.

Figure 11:
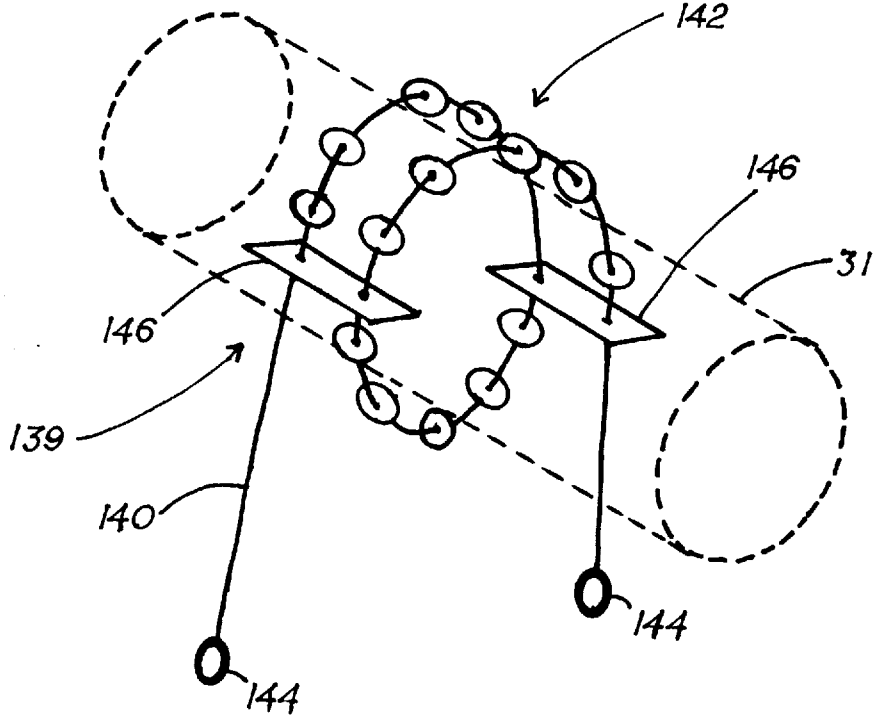
FIG. 11 is a detailed view of a second embodiment of a net frame roller mechanism includable in the soccer goal of FIG. 1.

FIG. 11 is a detailed perspective view of an alternative net frame roller mechanism 139. The roller mechanism 139 includes a wire 140 that loops around one of the support bars 31. Disposed along the wire 140 are a plurality of rollers 142. The wire 140 passes through the axis of each of the rollers 142 in a manner that allows the rollers 142 to freely rotate about their axes. The rollers 142 contact the support bar 31 and rotate as the net frame 28 is moved.

A pair of retainers 146 are fastened to the wire 140 on opposite sides of the support bar 31. The retainers 146 keep separated the rollers 142 on the top side of the support bar 31. Eyelets. 144 are attached to either end of the wire for connecting the roller mechanism 139 to the extensible arm 29.

Figure 12:
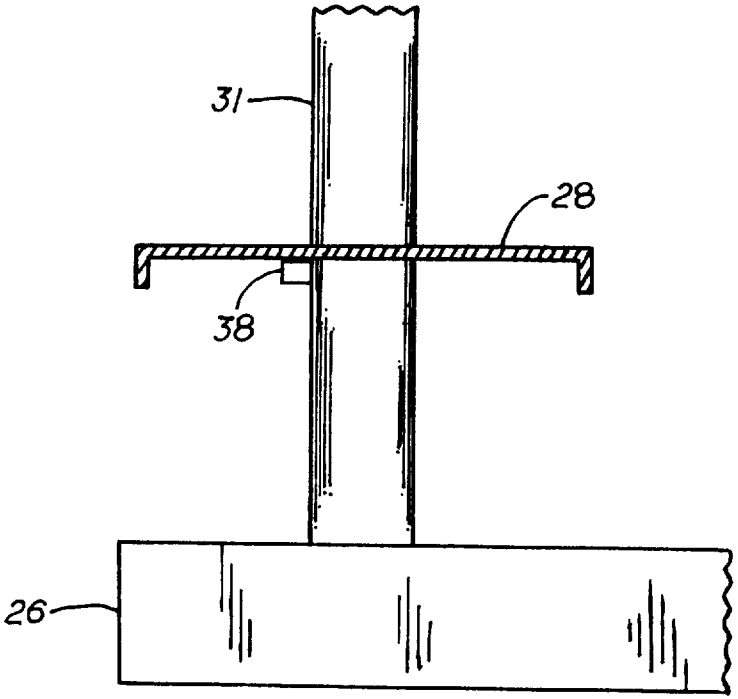
FIG. 12 is a detailed view of the spring-loaded push button shown in FIGS. 5–6.

FIG. 12 is a detailed back view of the spring-loaded push button 38 shown in FIGS. 5–6. The push button 38 is a safety feature that prevents the net frame 28 from dangerously slamming down on the housing 26. It is an alternative to the spring 101 shown in FIG. 7. A user depresses the push button 38 into the support bar 31 to allow the net frame 28 to pass.

Figure 13:
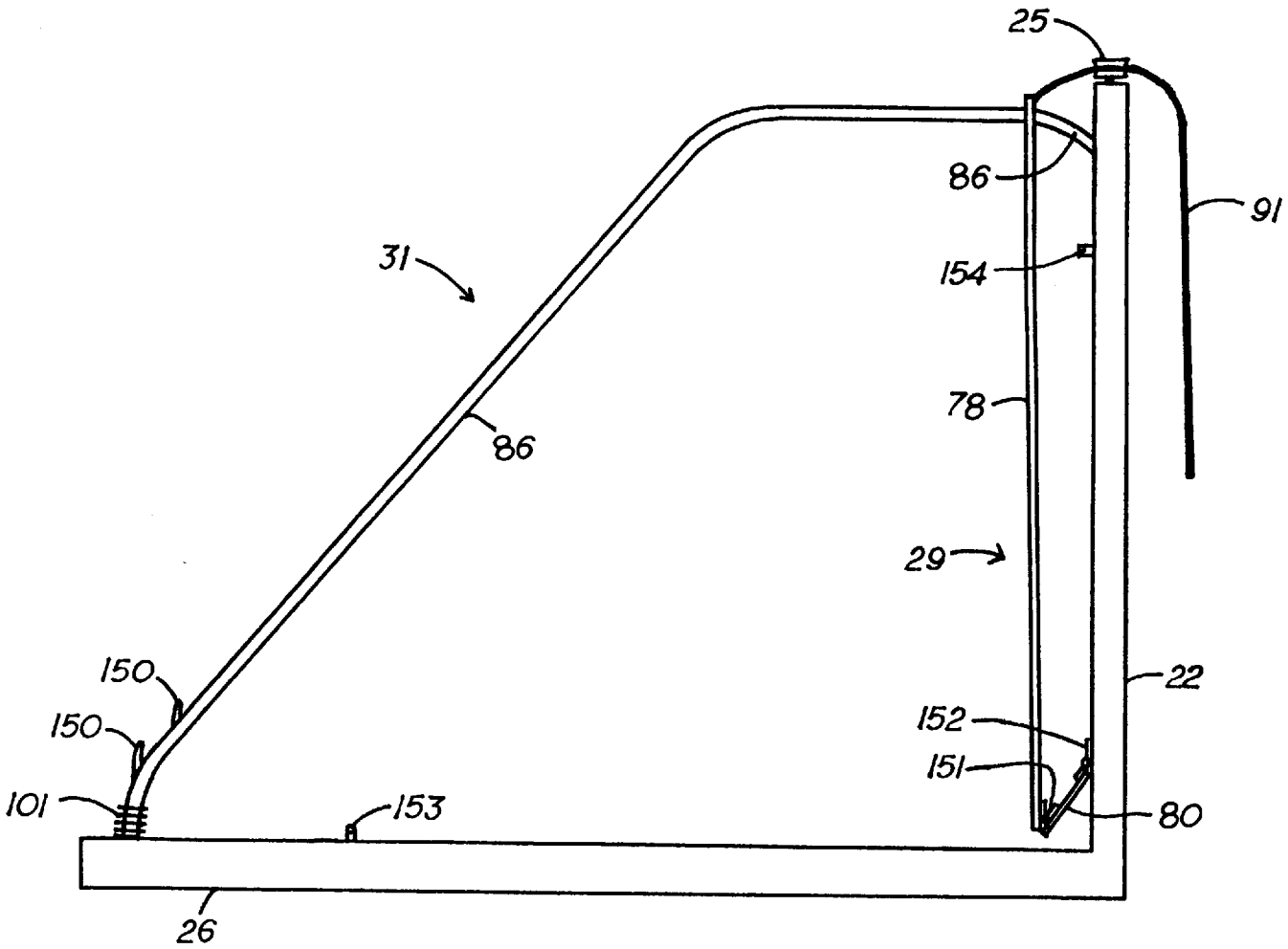
FIG. 13 is a side view of the soccer goal of FIG. 1 according to a third embodiment of the present invention.

FIG. 13 is a side view of the soccer goal of FIG. 1 according to a third embodiment of the present invention. In this embodiment, the primary bar 78 and secondary bar 80 are coupled with a first hinge 151. The secondary bar 80 is coupled to the post 22 by a second hinge 152. The hinges are preferably bolted to the bars 78, 80 and post 22; however, they may be welded in other embodiments.

The net frame 28 is locked into the horizontal position using a storage lock post 153. In the vertical position, the net frame 28 is locked to the goal frame using the goal frame lock post 154. The extensible arms 29 are provided with holes through which the lock posts extend when in either the vertical or horizontal position. A paddle lock or cotter pin is placed through a hole near the top of the lock post 153, 154 to secure the net frame 28 in position.

One or more shark tooth hooks 150 are mounted on the support bars 31. The purpose to the hooks 150 is to prevent the net frame from slamming against the housing 26.

Figure 14:
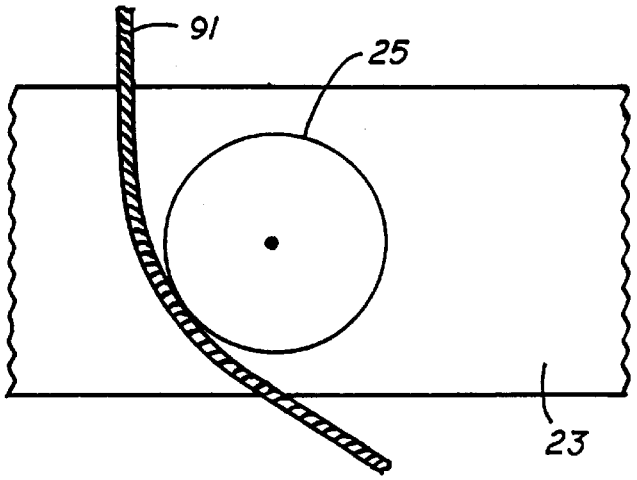
FIG. 14 is a top view of the pulley of FIG. 13.

FIG. 14 is a top view of the pulley of FIG. 13. The rope 91 is guided by the pulley 25 as the net frame 28 is raised or lowered. The pulley 25 reduces friction and wear of the rope 91.

Figure 15:
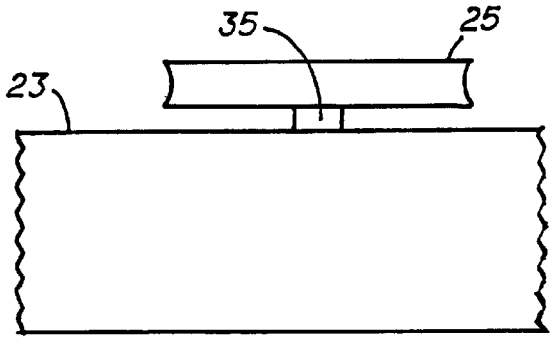
FIG. 15 is a side view of the pulley of FIG. 13.

FIG. 15 is a side view of the pulley of FIG. 13. The pulley 25 is preferable mounted horizontally on top of the cross bar 23. A spindle 35 passing through the axis of the pulley 25 is either welded or bolted to the cross bar 23.

Figure 16:
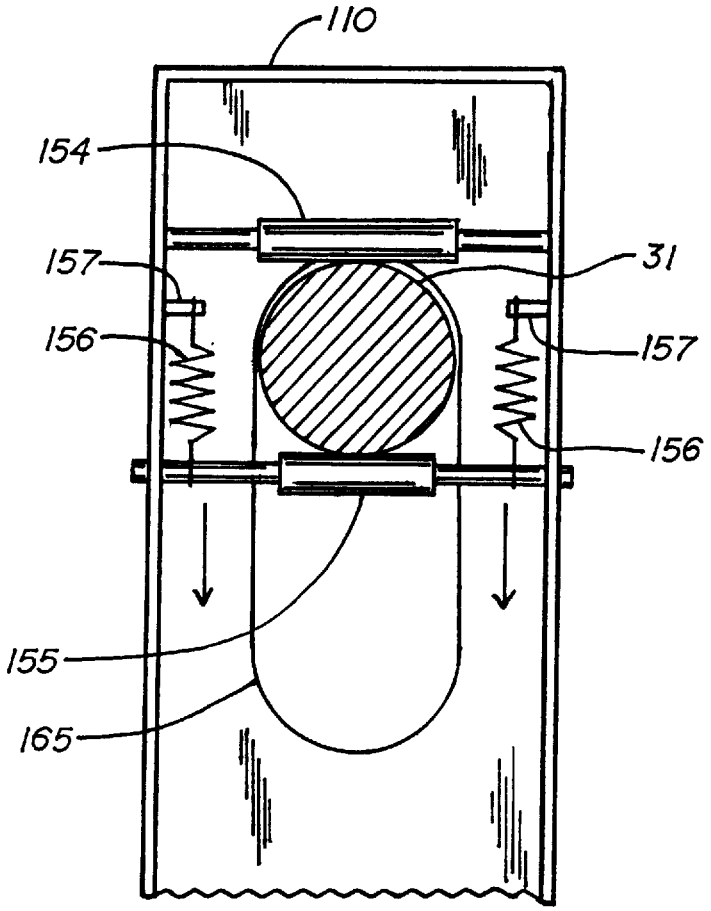
FIG. 16 is a detailed view of the net frame roller mechanism included in the soccer goal of FIG. 13.

FIG. 16 is a detailed view of a preferable net frame roller mechanism included in the soccer goal of FIG. 13. A cross-sectional view of one of the support bars 31 is shown passing through elongated hole 112 in the upper portion 110 of one of the extensible arms 29. The roller mechanism includes an upper roller 154, a slidable roller 155, a pair of retaining springs, and a pair of spring mounts 157. The rollers 154, 155 contact the support bar 31 and rotate about their axes as the net frame 28 is moved, thus reducing friction.

The slidable roller 155 is retained against the support bar by the springs 156, but is movable in the direction indicated by the arrows. This allows the net frame 28 to pass over the shark tooth hooks 150. When the net frame 28 is being moved into the vertical position, the roller mechanism allows it pass over the shark tooth hooks 150 without user intervention. However, when the net frame 28 is being moved from the vertical position into the horizontal position, it will come to rest on the shark tooth hooks 150. A user then pulls the slidable roller 155 in a direction away from the support bars 31 and the net frame 28 will pass over the hooks 150 and into the horizontal position.

Figure 17:
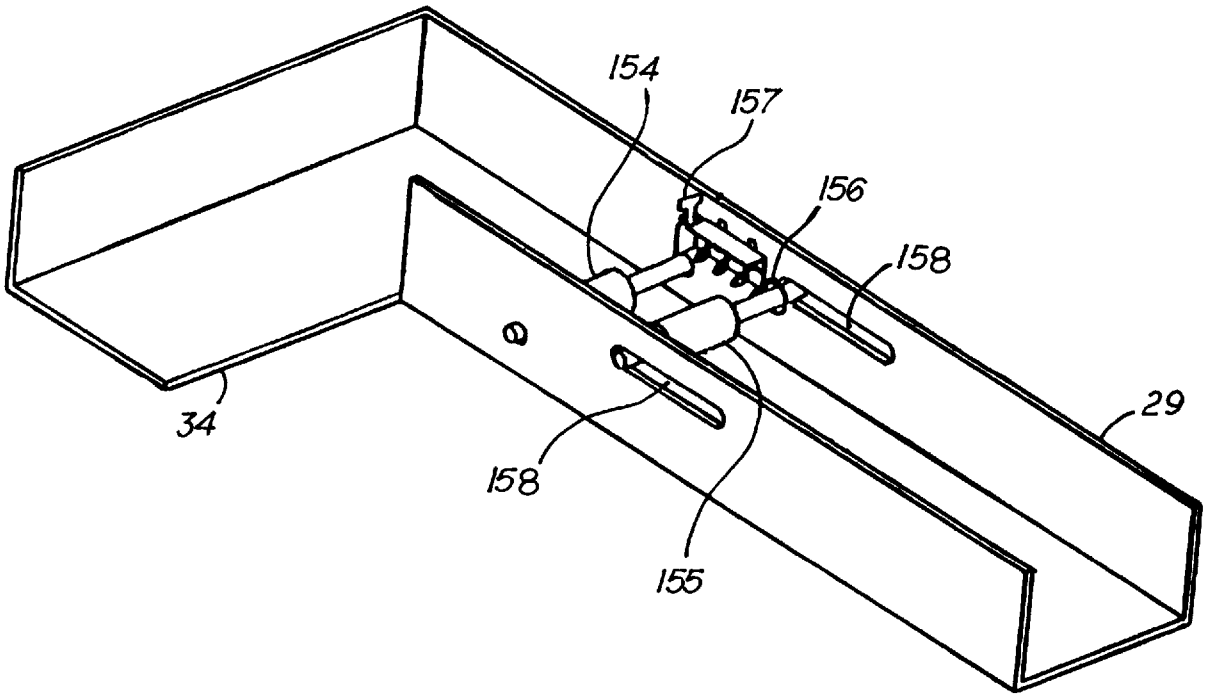
FIG. 17 is a perspective view of the net frame roller mechanism of FIG. 16.

FIG. 17 is a perspective view of the net frame roller mechanism of FIG. 16. The ends of the slidable roller extend through a pair of slots 158. The slots 158 in the walls of the extensible arm 29 allow the slidable roller 155 to move relative to the length of the extensible arm 29.

Figure 18:
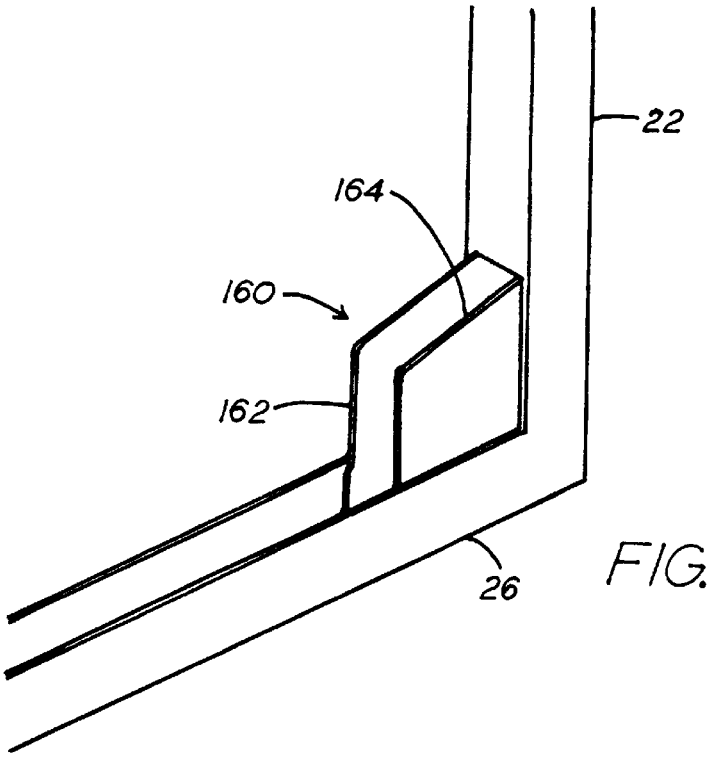
FIG. 18 is a detailed view of a shield that can be included in any the soccer goal embodiments shown in FIGS. 1, 5–7, and 13.

FIG. 18 is a detailed view of a shield 160 that can be included in any the soccer goal embodiments shown in FIGS. 1, 5–6, and 13. The shield 160 partially encloses the pivot points or hinges of the extensible arm 29. The shield 160 provides user safety and can maintain alignment of the primary and secondary bars 78, 80 of the extensible arm 29. The shield 160 includes an inner panel 162 and an outer panel 164. The inner and outer panels 162, 164 are mounted to the goal post 22 and housing 26 in a manner that allows the extensible arm 29 to pass between them.

Figure 19:
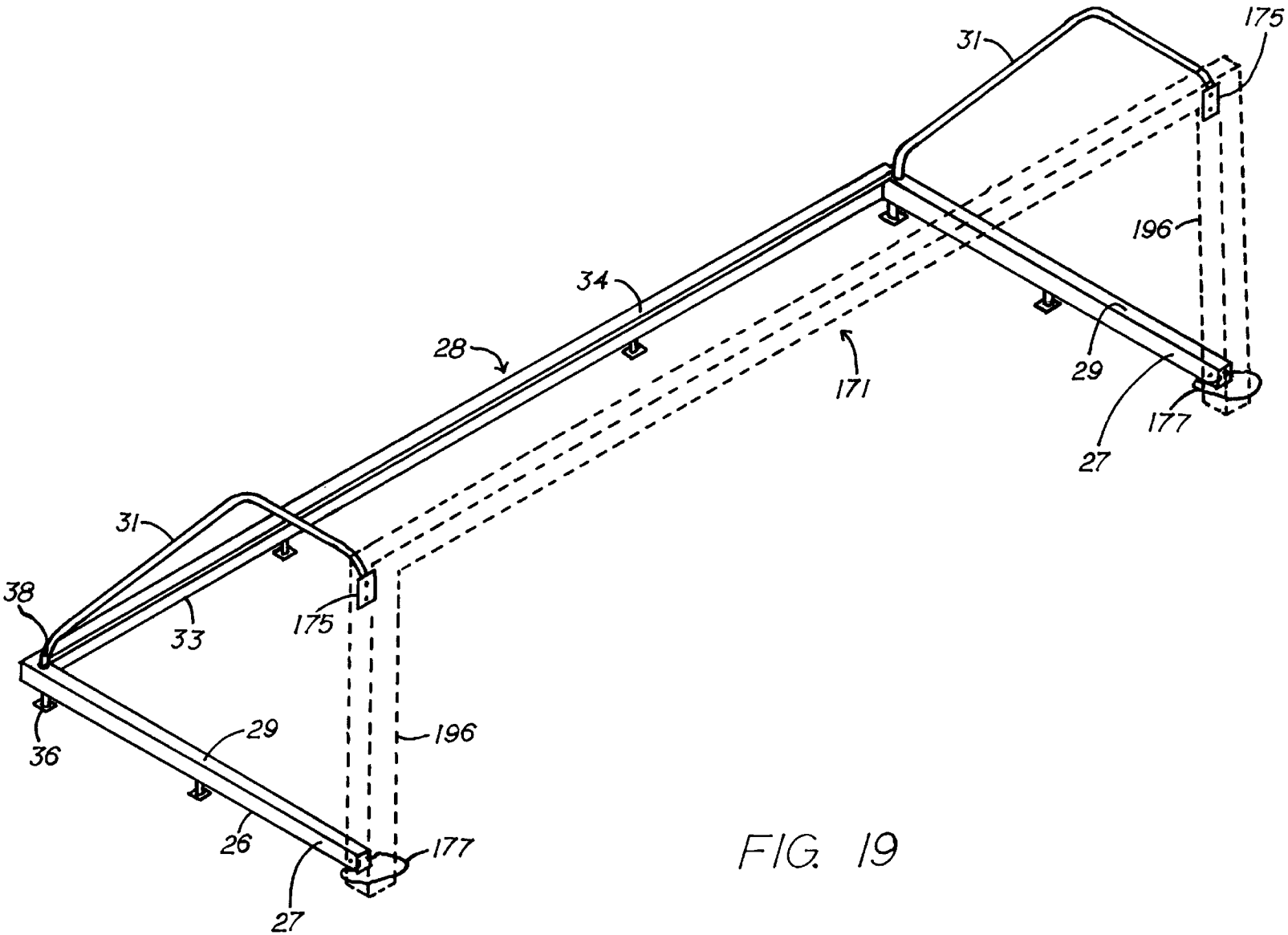
FIG. 19 is a perspective view of a soccer goal according to a fourth embodiment of the present invention.

FIG. 19 is a perspective view of a soccer goal according to a fourth embodiment of the present invention. This embodiment is an assembly kit that can be retrofitted to an existing goal frame 171.

The support bars 31 and housing 26 are adapted to attach to the existing goal frame 171. In various embodiments of the assembly kit, the extensible arms 29 are also adapted to attach to the existing goal frame 171. The support bars 31 include flanges 175 that can be bolted to the existing goal frame 171. The housing 26 includes cable winches 177 for fastening the housing to the goal frame 171.

In embodiments where the extensible arms 29 include pivots attached to the goal frame, as in FIGS. 5–6, the pivots are adapted to attach to the pre-existing goal frame 171. Preferably, a pair of forks (not shown), each having tangs through which a pivot passes, are bolted to the vertical posts 196 of the existing frame 171.

Figure 20:
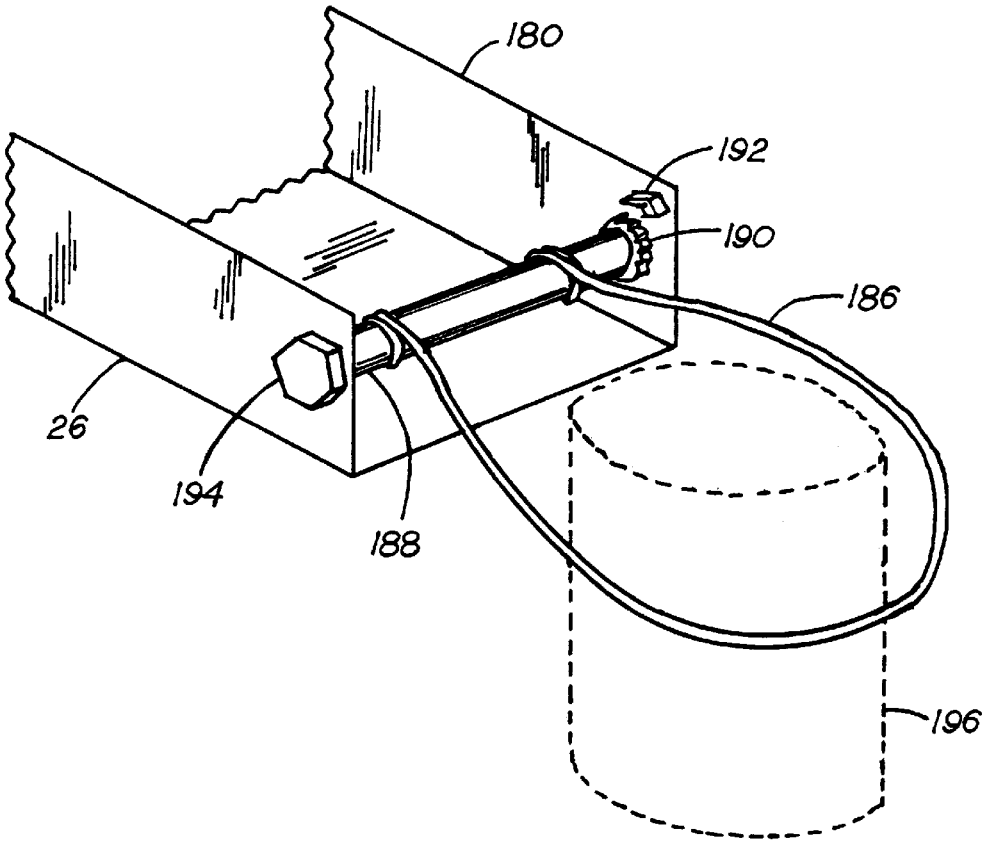
FIG. 20 is a detailed view of the cable winch shown in FIG. 19.

FIG. 20 is a detailed view of the cable winch 177 shown in FIG. 19. The cable winch 177 includes a drum 188 having a hexagonal head 194 at one end. At the opposite end is attached a ratchet wheel 190. The drum 188 passes through holes in the sides 180 of the housing 26 in a manner that allows the drum 188 to rotate about its axis. A cable 186 is detachably fastened to the drum 188 and extends around the vertical post 196.

To fasten the housing 26 to the post 196, the cable 186 is first extended around the post 196 and attached to the drum 188. The drum 188 is then rotated using a wrench or any other means adapted to fit the hexagonal head 194. As the drum 188 is rotated, the cable 186 winds around the drum 188, eventually pulling the housing 26 snugly against the vertical post 196.

To release the housing 26 from the vertical post 196, the release level 192 is depressed by the user and the cable 186 is unwound from the drum 188. One end of the cable 186 is detached from the drum 188 and the cable 186 is then removed from around the vertical post 196.

Alternatively, an electric cable winch can be provided instead of the manually operated winch shown in FIG. 20.

The embodiments of the soccer goal herein described can be assembled from kits. Due to the large size of a soccer goal, it is desirable for shipping to provide a soccer goal kit that can be easily package.

For example, a soccer goal kit in accordance with one embodiment of the present invention can include the housing 26 adapted to attach to the goal frame 20, pivots 82 adapted to attach to the goal frame 20, support bars 31 adapted to attach to the housing 26 and goal frame 20, and the net frame 28 having extensible arms 29 with ends adapted to connect to the pivots 82 and the net frame horizontal member 34.

The extensible arms 29 can include the off-axis pivot 84, the primary bar 78 having an end adapted to couple to the off-axis pivot 84, and the secondary bar 80 having an end adapted to couple to the off-axis pivot 84 and another end adapted to couple to one of the pivots 82.

In an assembly kit, the longer pieces of the soccer goal, such as the cross bar 23, net frame horizontal member 34, and housing back member 33, can be provided as shorter segments that are attachable to one another. For example, a twenty-four foot FIFA regulation cross bar can be provided in a kit as three eight foot segments that attach together. An example of this type of assembly is shown in FIG. 21.

Figure 21:
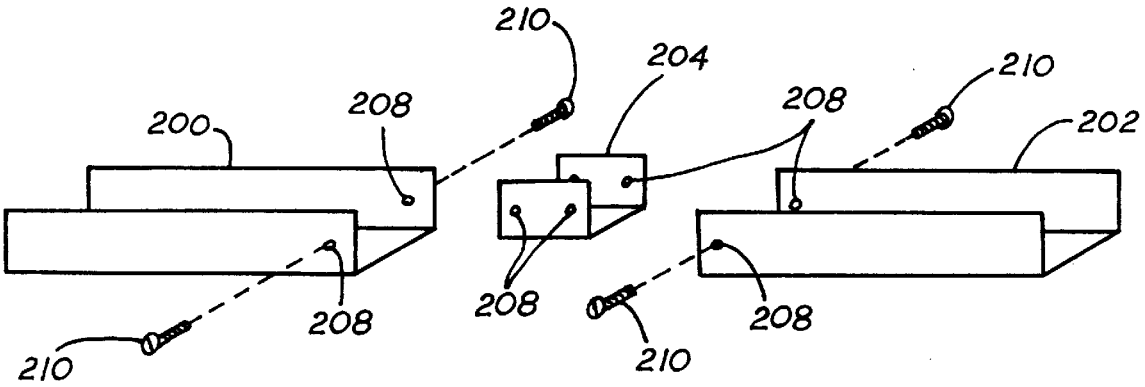
FIG. 21 is a partially exploded view of the housing assembly shown in FIGS. 1–3 and 19.

FIG. 21 is a partial exploded view of a housing assembly kit that can be assembled to form the housing 26 shown in FIGS. 1–3 and 19. The assembly includes a first segment 200, a second segment 202, a sleeve 204, and a plurality of nuts and bolts 210. The first and second segments 200,202 are butted against one another. The sleeve 204, is placed inside the trough formed by the segments and the corresponding holes 208 are aligned. The segments 200, 202 and sleeve 204 are then fastened together with the nuts and bolts 210.

The net frame 28, housing 26, and goal frame 20, and support bars 31 are preferably made of aluminum. However, it will be apparent to one of ordinary skill in the art that any suitable material, such a fiberglass, graphite composites, wood, steel or any other metal alloy, can be used to construct the soccer goal.

In another embodiment of the soccer goal, the functions of the goal frame and the housing are inverted. In this embodiment, the goal frame is hollow, providing a storage compartment for the net. The net is stored when the net frame is in the vertical position. Moving the net frame from the vertical to horizontal position unfurls the net over the support bars.

In summary, there has been described herein a concept, as well as a preferred embodiment, of a soccer goal that allows a soccer net to be conveniently stored when not in use and easily erected for game play. Because the embodiments of the soccer goal as herein-described utilize a pivotable net frame with extensible arms, the embodiments can readily conform with FIFA and NCAA standards for goal dimensions. In addition, various embodiments of the disclosed soccer goal include support bars that not only conform with NCAA standard dimensions for goal depth, but also have pitched segments that allow the net frame to be safely held in a vertical position until locked into place by a user. Embodiments of the soccer goal can come in ready to assemble kits, which greatly reduces the cost of shipping.

Furthermore, various embodiments of the soccer goal can be conveniently fitted onto existing goal frames, thus reducing the cost of upgrading established soccer playing fields.

While specific embodiments of the present invention have been shown and described, it will be apparent to those skilled in the art that the disclosed invention may be modified in numerous ways and may assume many embodiments other than the preferred form specifically set out and described above.

Accordingly, it is intended by the appended claims to cover all modifications of the invention which fall within the true spirit and scope of the invention.

What is claimed is:

1. A soccer goal, comprising:

a goal frame including a pair of vertical posts having upper and lower ends and a cross bar disposed between the upper ends of the vertical posts;

a housing connected to the lower ends of the vertical posts and extending substantially orthogonally from the vertical posts; and a net frame pivotable between the goal frame and the housing, the net frame having a horizontal member and a pair of extensible arms extending from either end of the horizontal member to a pair of pivots attached to a structure selected from the housing and the goal frame;

wherein the length of each of the extensible arms changes as the net frame is pivoted between the goal frame and the housing.

2. The soccer goal of claim 1, wherein the net frame includes:

a primary bar attached to one end of the horizontal member;

a secondary bar coupled to one of the pivots; and an off-axis pivot coupling the primary and secondary bars.

3. The soccer goal of claim 1, wherein at least one of the extensible arms includes:

a first bar; and a second bar slidable within the first bar.

4. The soccer goal of claim 1, further comprising:

at least one support bar, attached to the housing and the goal frame, for causing each of the extensible arms to move from a first length to a second length as the net frame is pivoted between the housing and the goal frame.

5. The soccer goal of claim 4, wherein the at least one support bar includes:

a first segment attached to the housing and extending to a bending point above the housing; and second segment extending from the bending point at a pitch to connect to the goal frame.

6. The soccer goal of claim 1, further comprising:

a spring for biasing the net frame into an open position.

7. The soccer goal of claim 1, further comprising:

a net connected to the housing and the net frame.

8. The soccer goal of claim 7, wherein the housing includes a compartment for storing the net.

9. The soccer goal of claim 8, wherein the compartment is lockable.

10. A soccer goal assembly kit, comprising:

a hollow housing attachable to a goal frame, the hollow housing having an open top side;

a pair of pivots adapted to attach to the goal frame;

a pair of rigid support bars adapted to attach to the hollow housing and extend vertically therefrom; and a net frame having a horizontal member and a pair of extensible arms with a first pair of ends adapted to rigidly attach to the horizontal member and a second pair of end adapted to connect to the pair of pivots, the net frame being adapted to slide over the support bars and to couple to the hollow housing at the open top side to form a compartment for storing a net.

11. The soccer goal assembly kit of claim 10, wherein at least one of the extensible arms includes:

an off-axis pivot;

a primary bar having an end adapted to attached to one end of the horizontal member and another end adapted to couple to the off-axis pivot; and a secondary bar having an end adapted to couple to the off-axis pivot and another end adapted to couple to one of the pivots.

12. The soccer goal assembly kit of claim 10, wherein at least one of the extensible arms includes:

a first bar having an end adapted to attach to one end of the horizontal member and a second end; and a second bar having an end adapted to couple to one of the pivots and another end adapted to slidably couple to the second end of the first bar.

13. The soccer goal assembly kit of claim 10, wherein at least one of the support bars includes:

a first segment attached to the hollow housing and extending to a bending point above the hollow housing; and a second segment extending from the bending point at a pitch to the goal frame.

14. The soccer goal assembly kit of claim 10, further comprising:

a plurality of anchors adapted to attach to the hollow housing.

15. The soccer goal assembly kit of claim 10, further comprising:

at least one cable winch, adapted to attach to the hollow housing, for fastening the hollow housing to the goal frame.

16. The soccer goal assembly kit of claim 10, wherein the hollow housing comprises:

a plurality of straight hollow segments adapted to connect together to form an open-top rectangular hollow housing.

17. A soccer goal, comprising:

a goal frame including a pair of vertical posts having upper and lower ends and a cross bar connecting the upper ends of the vertical posts;

a hollow housing including a pair of legs connected to the lower ends of the vertical posts and extending substantially orthogonally from the vertical posts and substantially parallel to each other, the hollow housing having an open top side;

a pair of rigid support bars attached to the goal frame and the legs of the hollow housing, each of the support bars including a first segment attached to the hollow housing and extending to a bending point at a first height and a second segment extending from the bending point to a location on the goal frame at a second height less than the first height;

a net frame pivotable between the goal frame and the housing, the net frame having a horizontal member and a pair of extensible arms extending from either end of the horizontal member to a pair of pivots attached to a structure selected from the group consisting of the housing and the goal frame, the net frame slidably engaging the support bars for causing the length of each of the extensible arms to change as the net frame is pivoted between the goal frame and the housing, and the net frame in a horizontal position engaging the hollow housing at the open top side to form an enclosure;

a net attached to the hollow housing and the net frame, the net being disposed above the support bars when the net frame is not in the horizontal position;

a lock, attached to the net frame, for locking the net frame to the goal frame; and a plurality of anchors, attached to the hollow housing, for securing the hollow housing to a surface.

18. The soccer goal of claim 17, wherein the net frame includes:

a primary bar attached to one end of the horizontal member;

a secondary bar coupled to one of the pivots; and an off-axis pivot coupling the primary and secondary bars.

19. The soccer goal of claim 17, wherein at least one of the extensible arms includes:

a first bar; and a second bar slidable within the first bar.

20. The soccer goal of claim 17, further comprising:

rope means, connected to the net frame, for pulling the net frame.

* * * * *